US008100446B1

(12) United States Patent
Moore et al.

(10) Patent No.: US 8,100,446 B1
(45) Date of Patent: Jan. 24, 2012

(54) COLLAPSIBLE BROOM AND DUSTPAN METHOD

(75) Inventors: Anthony D. Moore, Summerfield, NC (US); Bruce A. Angel, Kernersville, NC (US)

(73) Assignee: Camco Manufacturing, Inc., Greensboro, NC (US)

( * ) Notice: Subject to any disclaimer, the term of this patent is extended or adjusted under 35 U.S.C. 154(b) by 0 days.

(21) Appl. No.: 13/075,540

(22) Filed: Mar. 30, 2011

Related U.S. Application Data

(63) Continuation of application No. 12/777,316, filed on May 11, 2010, now Pat. No. 7,921,505, which is a continuation of application No. 12/548,632, filed on Aug. 27, 2009, now Pat. No. 7,743,458, which is a continuation of application No. 11/043,210, filed on Jan. 26, 2005, now Pat. No. 7,600,287.

(51) Int. Cl.
*A47L 13/52* (2006.01)

(52) U.S. Cl. ..... 294/1.4; 15/257.2

(58) Field of Classification Search ..... 15/257.2, 15/144.1, 144.4, 172; 294/1.4
See application file for complete search history.

(56) References Cited

U.S. PATENT DOCUMENTS

| | | | | |
|---|---|---|---|---|
| 226,551 | A | | 4/1880 | Randolph |
| 919,610 | A | | 4/1909 | Maeder |
| 1,871,146 | A | | 8/1932 | Bosler |
| 2,013,963 | A | | 9/1935 | Ingling |
| 3,362,037 | A | | 1/1968 | Griffin |
| 4,893,370 | A | | 1/1990 | Klotz |
| 5,313,683 | A | * | 5/1994 | Dickie et al. ..... 15/117 |
| 5,400,457 | A | | 3/1995 | Ridgley |
| 5,661,868 | A | | 9/1997 | Panagakos et al. |
| 6,256,829 | B1 | | 7/2001 | Hatch et al. |
| 6,709,529 | B1 | | 3/2004 | Mekwinski |
| 6,760,949 | B2 | | 7/2004 | Kaminstein et al. |
| 7,055,204 | B2 | | 6/2006 | Ajluni |
| 2005/0071943 | A1 | | 4/2005 | Liu |
| 2005/0235446 | A1 | | 10/2005 | Eggers |
| 2005/0283933 | A1 | | 12/2005 | Mitchell et al. |
| 2006/0123575 | A1 | | 6/2006 | Maloney et al. |

OTHER PUBLICATIONS

Printout of webpage from www.golfoutletsUSA.com showing TurfMaster; undated; 2 pages.
Printout of webpage from www.comet.it showing Swiffer Sweeper having a flexible swivel head; undated, 1 page.
Printout of webpage from www.higherpowersupplies.com showing a telescoping brush handle, copyright 1999-2004; 1 page.
Printout of webpage from www.overtons.com showing a Shurhold 6'telescoping handle; undated; 1 page.
Printout of webpage from amos.shop.com showing various telescoping handles; undated; 4 pages.
Three (3) pages from The Home Marketplace catalog; Summer Preview 2005; p. 56; Swivel-Head Extendable Broom; Two (2) pages showing Figs. A, B and C of Swivel-Head Extendable Broom; 5 pages total.

* cited by examiner

*Primary Examiner* — Randall Chin

(57) ABSTRACT

A collapsible broom and dustpan provide convenient, compact storage for use in RVs, mobile homes, efficiency apartments and the like with limited closet and storage space. The broom includes a standard telescoping handle which is affixed to a pivot joint on the broom head. The handle can be extended and rotated to a variety of selected angles. Tabs on the locking member within the pivot joint engage the handle girdle which surrounds the locking member. The locking member is spring loaded to maintain the handle at a desired position. The dustpan includes a handgrip which will accommodate the broom handle while the dustpan tray receives the broom head for compact storage. C-shaped clamps within the grip and a catch within the dustpan tray hold the broom within the dustpan until manually released therefrom.

17 Claims, 4 Drawing Sheets

COLLAPSIBLE BROOM AND DUSTPAN METHOD

This is a continuation of and claims benefits under prior application Ser. No. 12/777,316 filed 11 May 2010, now U.S. Pat. No. 7,921,505 which is a continuation of prior application Ser. No. 12/548,632 filed 27 Aug. 2009, now U.S. Pat. No. 7,743,458 which is a continuation of prior application Ser. No. 11/043,210 filed 26 Jan. 2005, now U.S. Pat. No. 7,600,287, each of which are incorporated by reference in their entirety herein.

FIELD OF THE INVENTION

The invention herein pertains to cleaning and maintenance tools and particularly pertains to a broom which is collapsible and can be stored with a dustpan in compact fashion during periods of nonuse.

DESCRIPTION OF THE PRIOR ART AND OBJECTIVES OF THE INVENTION

In recent years the growth of the recreational vehicle (RV) and camping industries has spurred the development of many products peculiar thereto. Campers, mobile homes, RVs and other vehicles each have limited closet and storage space. As a result, standard cleaning equipment such as brooms are often stored exposed in inconvenient areas due to the handle length. Thus, in view of the problems and disadvantages of storing such conventional maintenance equipment in campers, recreational vehicles and in other areas with limited space, the present invention was conceived and one of its objectives is to provide a broom which can be greatly reduced in length for storage purposes.

It is another objective of the present invention to provide a broom having a collapsible, telescoping handle which can be easily retracted, rotated and extended as needed.

It is also an objective of the present invention to provide a collapsible broom which will nest in the removable dustpan for compact convenient storage.

It is still a further objective of the present invention to provide a collapsible broom having a handle which is pivotally attached to the broom head for selective positioning therewith.

It is yet another objective of the present invention to provide a collapsible broom having a pivot joint on the broom head for manual adjustment of the handle as required.

Various other objectives and advantages of the present invention will become apparent to those skilled in the art as a more detailed description is set forth below.

SUMMARY OF THE INVENTION

The aforesaid and other objectives are realized by providing a collapsible broom having a standard, telescoping handle. The handle can thus be extended and retracted as desired along its four (4) sections. The distal end of the handle includes a girdle in a pivot joint which engages a cylindrical locking member. The locking member passes through a pair of ears affixed to the base of the broom head. The girdle, locking member and ears form a pivot joint which allows the handle to selectively rotate into parallel alignment with the head for compact storage purposes. When the broom is used for sweeping the handle is rotated through the pivot joint to an angle of approximately one hundred five degrees(105°) from the broom head. The pivot joint includes a coil spring which surrounds the locking member. The locking member includes two (2) pairs of locking tabs which engage keyways in the girdle and ears in selective fashion to maintain the desired position of the handle in relation to the broom head. To change the handle angle to the broom head the locking member is urged outwardly by applying finger pressure to the locking pin. The finger pressure compresses the spring between one of the ears and the spring retainer which allows the tabs on the locking member to escape the keyways. Once the tabs disengage the girdle and ear keyways the handle is free to rotate in the pivot joint to a desired position where the locking tabs engage a different keyway in the ears and are locked therein by the force of the resilient coil spring.

To store the combination broom and dustpan, the broom handle first is collapsed and rotated as described above into a position parallel with the base of the broom head. The broom so configured is placed within the dustpan which comprises a tray and a handgrip having a channel. The broom head is placed within the tray whereby a catch in the tray engages the lower end of the handle while clamps within the channel of the handgrip engage the handle to provide a secure condensed broom and dustpan which can be easily stored on a closet shelf, in a cabinet or other small area.

DETAILED DESCRIPTION OF THE PREFERRED EMBODIMENT AND OPERATION OF THE INVENTION

Figure 1:
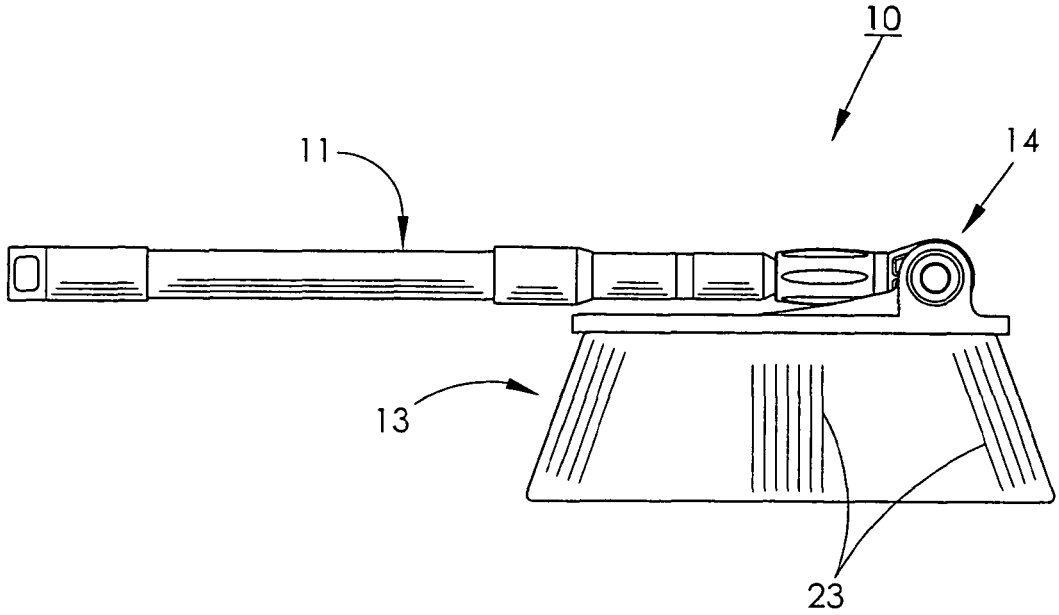
FIG. 1 shows a right side elevational view of the preferred form of the broom with the handle collapsed and folded into parallel relation with the broom head.
Figure 2:
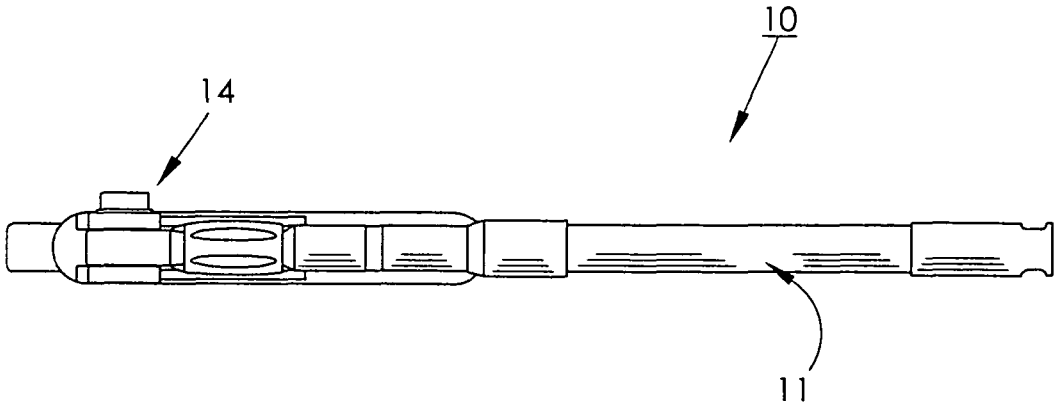
FIG. 2 illustrates a top plan view of the broom as shown in FIG. 1.
Figure 3:
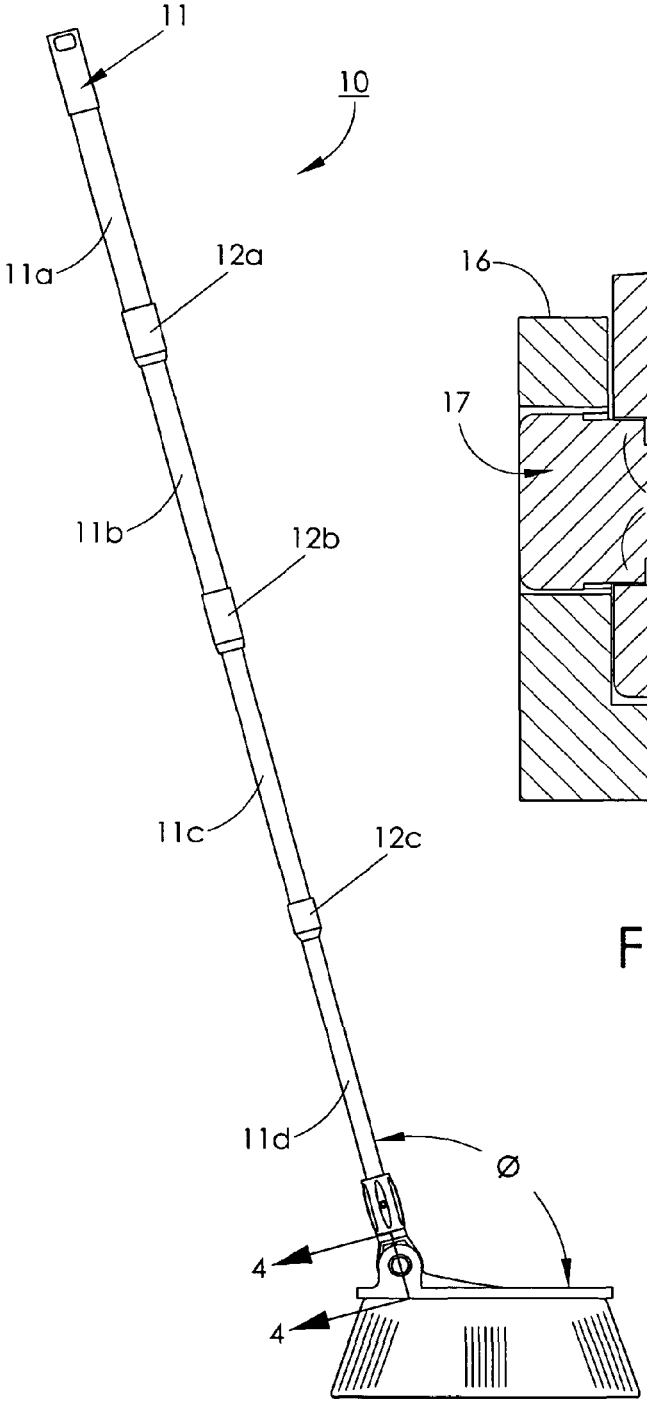
FIG. 3 pictures the broom of FIG. 1 with the handle fully extended and pivoted from the head as for use in sweeping.

For a better understanding of the invention and its operation, turning now to the drawings, FIG. 1 illustrates a right side view of preferred collapsible broom 10 as seen with conventional telescoping handle 11 in a retracted posture and pivoted closed with handle 11 parallel to elongated broom head having multiple bristles 23. Handle 11 is selectively rotatable through pivot joint 14 also seen in FIG. 2 in a top view. Conventional handle 11 is tubular in shape and includes a plurality of four (4) sections (11*a*-11*d*) as seen in FIG. 3. Positioned along handle 11 are standard collars (12*a*-12*c*), each rigidly formed to handle sections 11*a*-11*c* respectively. Collars 12*a*-12*c* can each be rotated clockwise to prevent retraction or allow for extension of sections 11*a*-11*d* as is standard in the trade. Clockwise rotation of collar 12*a* with handle section 11*a*, as seen in FIG. 3, locks handle section 11*a* in an extended posture with handle section 11*b*. Handle section 11*b* can then be rotated in a clockwise direction to lock handle sections 11*b* and 11*c* to prevent relative movement therebetween. Counterclockwise rotation of collar 12*a* and handle section 11*a* for example disengages handle section 11*a* from handle section 11*b* to allow sections 11*a* and 11*b* to telescope as needed.

Figure 4:
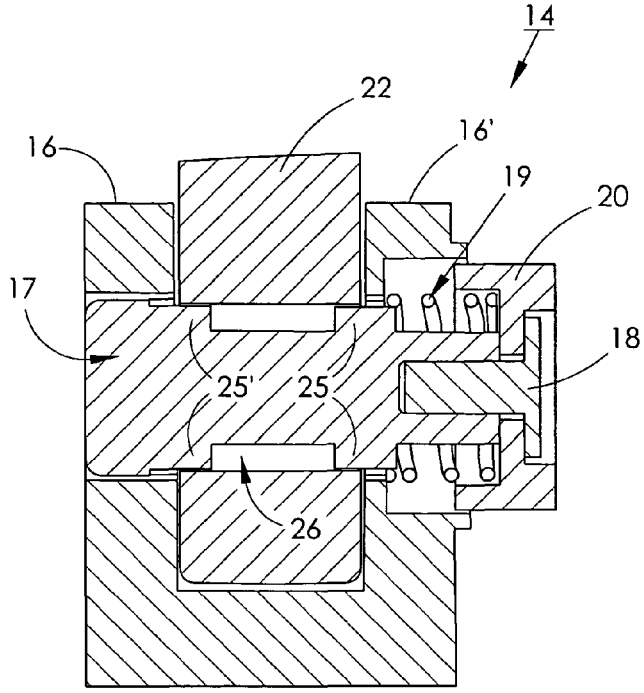
FIG. 4 depicts an enlarged cross-sectional view of the locked pivot joint as seen along lines 4-4 in FIG. 3.
Figure 6:
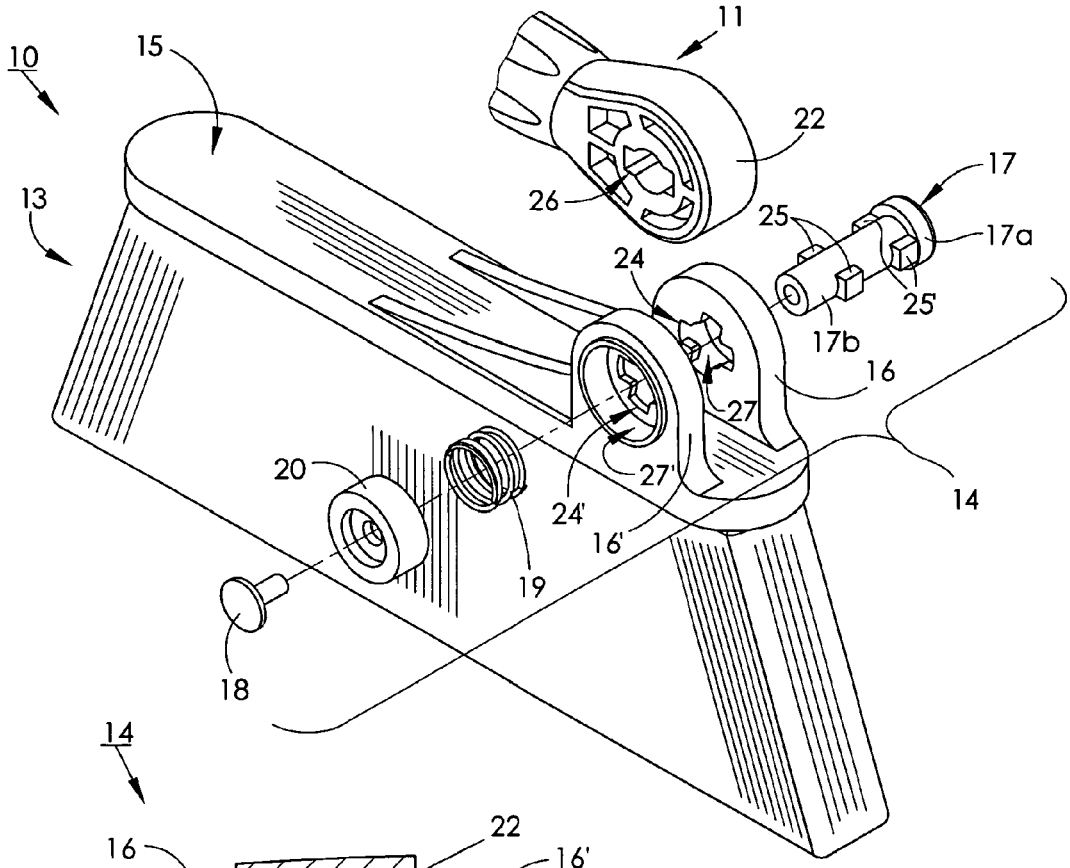
FIG. 6 shows the pivot joint in an exploded fashion to detail the components thereof.
Figure 5:
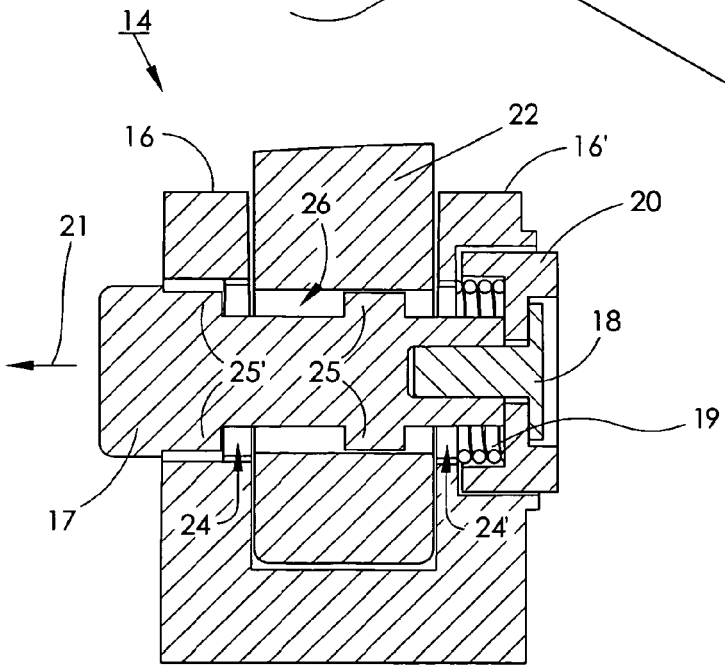
FIG. 5 demonstrates the pivot joint as in FIG. 3 but with the locking member urged inwardly to allow the handle to freely rotate.

Pivot joint 14 as seen in FIG. 6 includes ears 16, 16' integrally formed with base 15 and each defining indents 27, 27' and keyways 24, 24' respectively. Cylindrical locking member 17 includes knob 17*a*, shaft 17*b* and biasing tabs 25, 25'. Locking member 17 passes through keyways 24, 24' in ears 16, 16', and girdle 22 of handle 11 where it is secured therein by locking pin 18. Locking pin 18 is frictionally engaged within locking member 17 and secures spring retainer 20 therebetween as shown in FIGS. 4 and 5. Coil spring 19 is located between spring retainer 20 and ear 16' and surrounds shaft 17*b* of locking member 17 as seen in FIG. 6. Resilient coil spring 19 prevents rotation of girdle 22 by biasing tabs 25, 25' of locking member 17 in keyway 26 of girdle 22 as seen in FIG. 4. Thus, girdle 22 can be released, rotated and re-engaged in pivot joint 14 so handle 11 is in an upright posture as shown in FIG. 3 by angle ø, approximately one hundred and five degrees (105°) from its collapsed position (FIG. 1). Handle 11 is positioned at zero degrees (0°) in FIG. 1 and can thereafter be raised to angle ø for normal sweeping as seen in FIG. 3. Tabs 25, 25' engage girdle keyway 26 as seen in FIG. 4 and ear keyways 24, 24' to lock handle 11 in a desired posture, such as in FIGS. 1 and 3. In the preferred form of collapsible broom 10, girdle keyway 26 accepts locking tabs in a longitudinal direction relative to handle 11, whereas ear keyways 24, 24' accept locking tabs 25, 25' in either a vertical or horizontal direction to lock handle 11 at zero degrees (0°) or about one hundred and five degrees) (105°. Other forms of the invention may have additional keyways as desired for locking handle 11 at other angles (not shown).

In use, finger pressure is axially applied to locking pin as seen in FIG. 5 thereby compressing spring 19 between spring retainer 20 and ear 16' while moving locking member 17 in an outwardly direction as shown by arrow 21. This outward movement releases tabs 25, 25' of locking member 17 from keyways 24, 24' in ears 16, 16' allowing girdle 22 of handle 11 to rotate through pivot joint 14 to another desired position.

Figure 7:
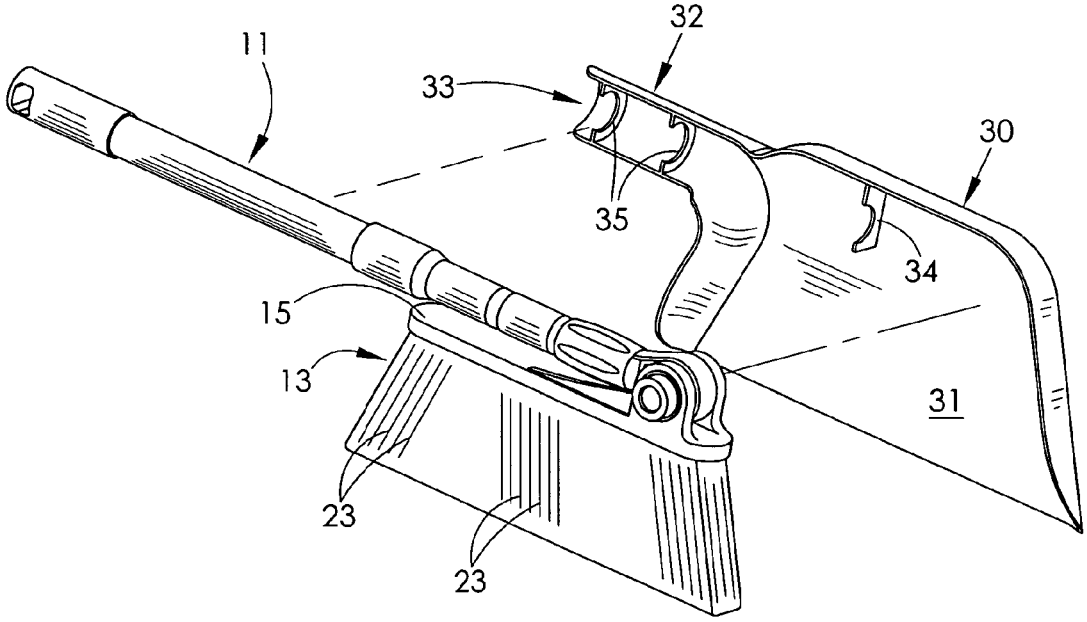
FIG. 7 shows the combination broom and dustpan with the broom in a collapsed manner as in FIG. 1, and exploded from engagement with the dustpan.

In FIG. 7 broom 10 is shown in a collapsed posture with head 13 containing conventional nylon bristles 23. Preferred dustpan 30 is preferably molded from suitable polymeric materials such as polypropylene although other materials may be used and includes tray 31 with hand grip 32 laterally affixed thereto. Hand grip 32 includes channel 33 which communicates with tray 31. As further shown, catch 34 molded within tray 31 engages handle 11 whereas c-shaped clamps 35 molded in channel 33 also engage handle 11 for security purposes. Catch 34 and clamps 35 each include an arcuate opening to frictionally engage handle 11. Handle 11 is thus securely held by catch 34 and clamps 35 and is also allowed to be manually removed therefrom as needed.

The illustrations and examples provided herein are for explanatory purposes and are not intended to limit the scope of the appended claims.

We claim:

1. A method of assembling a collapsible broom and dust pan for storage comprising the steps of:

a) providing a broom with a telescoping handle attached to a broom head with bristles;

b) providing a dust pan having a tray with an attached grip and a catch mounted within the tray;

c) collapsing the telescoping broom handle;

d) rotating the telescoping broom handle against the broom head; and e) placing the broom head in the tray with the telescoping broom handle in the dust pan grip.

2. The method of claim 1 further comprising the step of:

a) storing the broom and dust pan in an RV.

3. The method of claim 1 wherein providing a broom comprises the step of providing a broom with the handle rotatably connected to an ear on the broom head.

4. The method of claim 1 wherein providing a dust pan comprises the step of providing a dust pan formed from a polymeric material.

5. The method of claim 1 wherein providing a dust pan with a catch comprises the step of providing a catch having an arcuate opening for handle engagement.

6. The method of claim 1 wherein providing a broom comprises the step of providing a broom with a pair of ears affixed to the broom head with the handle rotatably attached between the pair of ears.

7. The method of claim 1 further comprising the step of storing the assembled collapsible broom and dust pan during periods of non-use.

8. The method of claim 7 further comprising the step of using the broom for sweeping by:

a) disengaging the broom from the dust pan; and b) rotating the handle from the broom head.

9. The method of claim 8 further comprising the step of extending the broom handle from its collapsed posture.

10. A method of assembling a collapsible broom and dust pan for storage comprising the steps of:

a) providing a broom with a telescoping handle rotatably attached to an ear on a broom head having bristles;

b) providing a dust pan having a tray with an attached grip and catch;

c) collapsing the telescoping broom handle;

d) rotating the telescoping broom handle against the broom head; and e) placing the broom head in the tray with the telescoping broom handle in the dust pan grip.

11. The method of claim 10 wherein providing a dust pan comprises the step of providing a dust pan with the catch mounted within the tray.

12. The method of claim 10 wherein providing a dust pan comprises the step of providing a dust pan formed from a polymeric material.

13. The method of claim 10 wherein providing a dust pan with a catch comprises the step of providing a catch having an arcuate opening for handle engagement.

14. The method of claim 10 wherein providing a broom comprises the step of providing a broom with an additional ear affixed to the broom head with the handle rotatably attached between the pair of ears.

15. The method of claim 10 further comprising the step of storing the assembled collapsible broom and dust pan during periods of non-use.

16. The method of claim 15 further comprising the step of using the broom for sweeping by:

a) disengaging the broom from the dust pan; and b) rotating the handle from the broom head.

17. The method of claim 16 further comprising the step of extending the broom handle from its collapsed posture.

* * * * *